US006497639B2

(12) United States Patent
Webber et al.

(10) Patent No.: US 6,497,639 B2
(45) **Date of Patent: *Dec. 24, 2002**

(54) WEIGHT STACK APPARATUS FOR EXERCISE MACHINE

(75) Inventors: Randall T. Webber, San Diego, CA (US); Bruce Hockridge, San Diego, CA (US); Robson L. Splane, Granada Hills, CA (US); Ben Ton, Canoga Park, CA (US)

(73) Assignee: Hoist Fitness Systems, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/742,211

(22) Filed: Dec. 20, 2000

(65) Prior Publication Data

US 2001/0001777 A1 May 24, 2001

Related U.S. Application Data

(63) Continuation of application No. 09/338,126, filed on Jun. 22, 1999, now Pat. No. 6,193,635.

(51) Int. Cl.[7] ..... A63B 21/062

(52) U.S. Cl. ..... 482/98; 482/99; 482/138

(58) Field of Search ..... 482/93, 94, 97–103, 482/138, 106–109, 105; 177/252, 235; D21/675, 680

(56) References Cited

U.S. PATENT DOCUMENTS

| | | | | | |
|---|---|---|---|---|---|
| 90,304 | A | * | 5/1869 | Reilly | 482/94 |
| 620,606 | A | * | 3/1899 | MacCawley et al. | 177/252 |
| 772,906 | A | * | 10/1904 | Reach | 482/98 |
| 2,033,212 | A | * | 3/1936 | Walker | 177/250 |
| 3,257,111 | A | * | 6/1966 | Martin | 482/98 |
| 3,647,209 | A | * | 3/1972 | La Lanne | 482/103 |
| 3,840,227 | A | * | 10/1974 | Chesemore | 482/102 |
| 5,054,773 | A | * | 10/1991 | Parviainen | 482/98 |
| 5,374,229 | A | * | 12/1994 | Sencil | 482/98 |
| 5,417,630 | A | * | 5/1995 | Schultz | 482/70 |
| 6,193,635 | B1 | * | 2/2001 | Webber et al. | 482/98 |

FOREIGN PATENT DOCUMENTS

| | | | | |
|---|---|---|---|---|
| GB | 2 135 894 A | * | 9/1984 | 482/108 |

* cited by examiner

*Primary Examiner*—Jerome W. Donnelly
*Assistant Examiner*—Victor Hwang
(74) *Attorney, Agent, or Firm*—Brown, Martin, Haller & McClain LLP

(57) ABSTRACT

A stackable weight plate for an exercise machine weight stack has a front edge, a rear edge, opposite side edges, an upper face, a lower face, and an aperture extending between the upper and lower face for receiving a weight stack selector stem. The front and rear edges having a matching arcuate curvature with one edge being convex and the other edge being concave, and the side edges are tapered at an angle from the front edge to the rear edge.

14 Claims, 5 Drawing Sheets

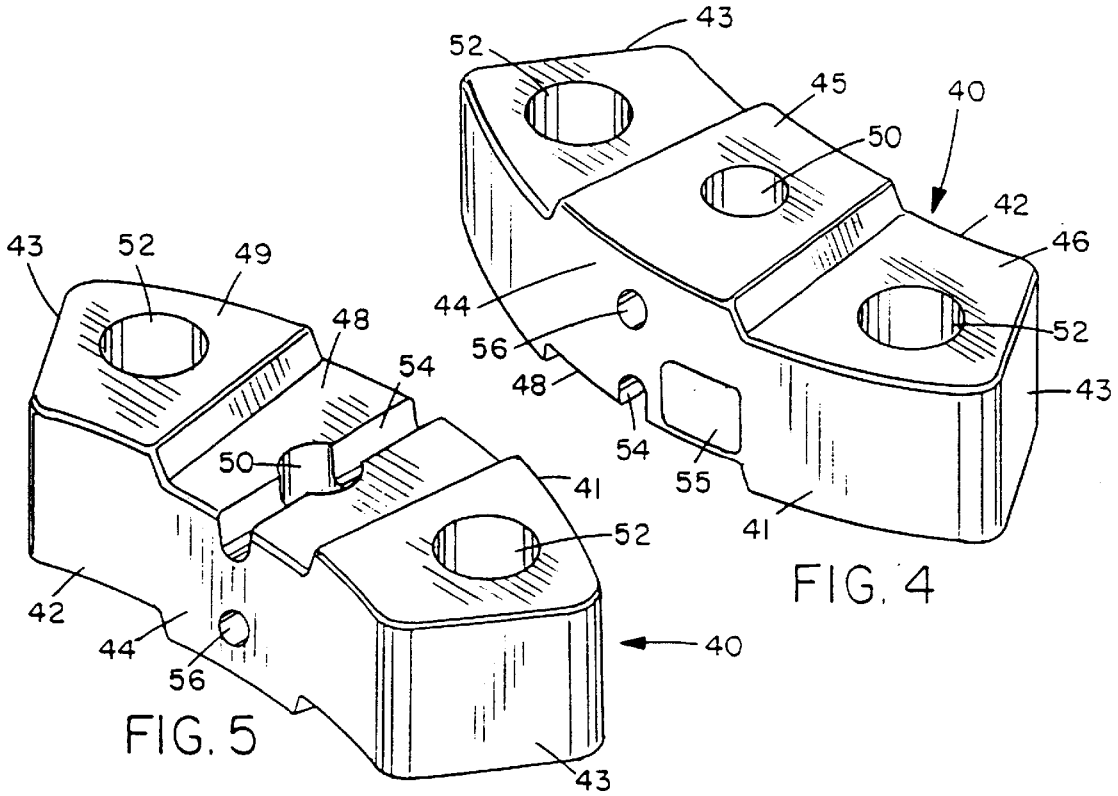
FIG. 4
FIG. 5
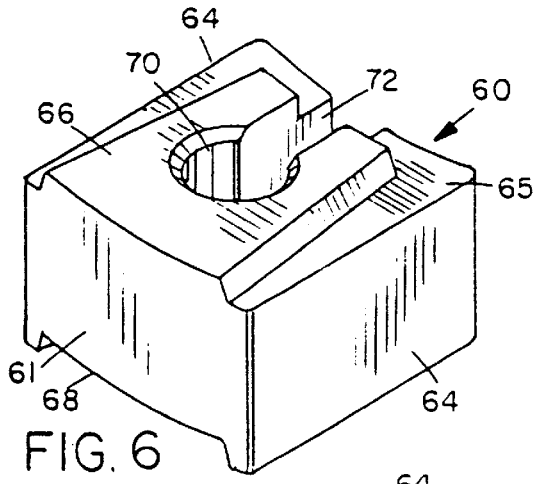
FIG. 6
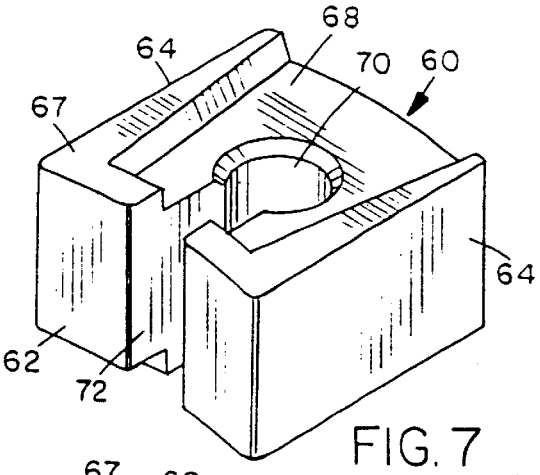
FIG. 7
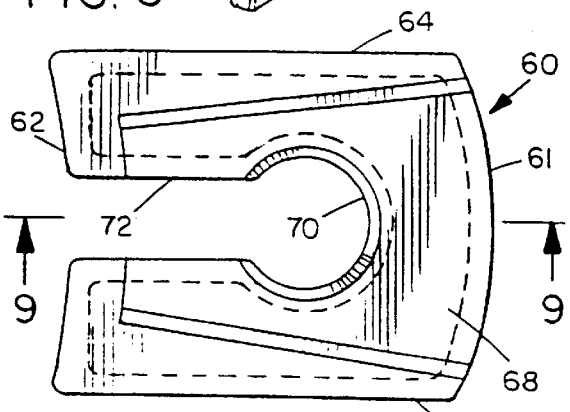
FIG. 8
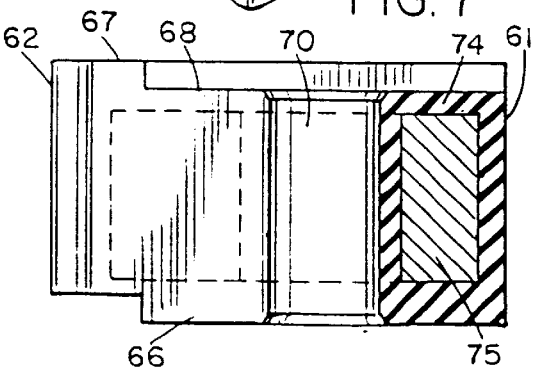
FIG. 9

WEIGHT STACK APPARATUS FOR EXERCISE MACHINE

This application is a continuation of prior application Ser. No. 09/338,126 filed Jun. 22, 1999, now U.S. Pat. No. 6,193,635.

BACKGROUND OF THE INVENTION

The present invention relates generally to a stackable weight plate and weight stack apparatus employing a plurality of the weight plates for use in a weight lifting exercise machine.

There are two basic types of weight plate used in resistance training. The first type consists of free weights used on barbells and dumbbells, which are usually hand held but which can be loaded on a machine. The second type are generally known as selector weights, which are always attached to exercise machines.

Free weights are one of the earliest forms of weight plates used in resistance training or exercising. They are usually circular in shape, and have a central aperture which allows them to be fitted on a round, bar type handle or machine mounted receiver. They typically come in multiple weight increments, and can be loaded or unloaded by the user in order to increase or decrease the resistance during an exercise. This is dangerous, cumbersome, and requires repeated loading and unloading during the course of an exercise routine. It also requires the exerciser to have a quantity of free weight plates on hand. Often, in a health clubs, the weight plates will be moved from one station to another, and it can be hard to locate a specific plate when needed. U.S. Design Pat. No. 406,183 of Zovich illustrates a typical free weight plate of generally circular shape.

Selector weights are stacked one plate on top of another and are a permanent part of a weight lifting exercise machine. A typical weight stack consists of a series of stacked weight plates each with a central opening, and a selector stem engaging through the central openings of the stacked plates. The selector stem has a series of holes, one for each weight in the stack. The stem is attached to the top plate in the stack and protrudes downwards through the stack, and the top plate is linked via a cable and pulley assembly to one or more exercise stations. Each plate has a transverse opening extending from the front of the stack through to the central opening. A selector pin can be inserted through any selected weight in the stack and into the aligned hole in the selector stem. The selected weight and all weights above it in the stack will then be lifted. The amount of resistance can easily be adjusted by removing the pin and inserting it through a higher or lower weight in the stack, decreasing or increasing the resistance, respectively. The pin therefore selects the number of plates to be lifted.

Weight stacks usually travel up and down on a slide or guide rod system, and are connected to a movable exercise member by means of a linkage system such as a belt and pulley, cable and pulley, pivoting linkage, rigid lever arm, or the like.

The selector weights generally come only in relatively large increments of 5, 10, 15, and 20 lbs, for example. Thus, add-on or incremental weights are often provided to allow the exerciser to adjust the weight stack in smaller increments. Thus, if a person using a weight stack with ten pound increments could not make a ten pound step up in resistance, they could add a five pound add-on or incremental weight on top of the stack to increase the resistance by half a step. Normally, add-on weights are not connected in any way to the machine and must be placed on and off the weight stack by the user. These weights can shift during movement and rub against the weight stack guide rods. This will create friction or drag which can be felt by the user.

Selector weight plates are typically made from steel flat bar or cast iron. Steel plates are cut from flat bar stock into a generally rectangular shape. Cast iron plates are poured from molten iron and are also usually rectangular in shape. In all cases, the rear edge or face of the plate is straight and the side edges are at 90 degrees to the rear face. Weight stacks of rectangular weight plates are described in U.S. Pat. No. 5,374,229 of Sencil, U.S. Pat. No. 5,308,304 of Habing, and U.S. Pat. No. 5,779,601 of Ish, III, for example. Some selector weight plates are provided with locating or nesting devices to keep the weights aligned with one another when stacked. One common nesting device is a button and hole device, in which one or two buttons on the top of one weight plate nest into holes located on the underside of another weight plate. Another nesting arrangement involves interlocking sleeves which engage in the central opening of a weight plate and which have a series of ridges and valleys which mate when one weight plate is placed on top of another. The purpose of such nesting arrangements is to help align the plates as they are stacked, and also to prevent shifting or twisting of one plate relative to another during use.

The problem with the button and hole type of nesting arrangement is that the shape and size of the buttons is such that they do not provide much help in preventing the weights from shifting or twisting from side to side. Because the buttons and holes are in line with the guide rods, any shifting will cause the guide rod holes to rub against the guide rods before the buttons can prevent it. This creates friction and causes the exerciser to feel drag in the exercise movement. Also, since the buttons must be cast or molded into the weights, the weight plates are not uniform in thickness. In a casting process, it is preferable for the molds to be a uniform thickness so that molten material is allowed to flow unobstructed through the mold cavity. Any variation could cause the molten iron not to fill the button-forming recess. A less than perfect pour could cause the buttons and holes not to align.

SUMMARY OF THE INVENTION

It is an object of the present invention to provide a new and improved weight plate and weight plate system for an exercise machine.

According to one aspect of the present invention, a stackable weight for an exercise machine weight stack is provided, which comprises a plate having a front edge, a rear edge, and opposite side edges, and an upper face and a lower face, the plate having an aperture extending between the upper and lower face for receiving a weight stack selector stem, the front and rear edges having a matching arcuate curvature with the front edge being convex and the rear edge being concave, and the side edges each having an inwardly angled taper from the front edge to the rear edge.

There are several advantages to the shape of the weight plate. The curvature and inwardly angled side edges allow a series of weight stacks to be more easily grouped in a circular or part-circular fashion for a multi-station exercise machine requiring multiple weight stacks. This will take up less space than multiple rectangular weight stacks. The concave rear edges also provides space at the rear of the weight stack allowing a cable to be routed without requiring any additional space.

According to another aspect of the present invention, a stackable weight is provided which comprises a plate having front and rear edges and opposite side edges, upper and lower faces, and a selector stem aperture extending between the upper and lower faces, the upper face having a raised central rib extending from the front edge to the rear edge and the lower face having a central indent extending from the front edge to the rear edge and of shape and dimensions matching that of the central rib on the upper face, whereby plates can be stacked together with the central indent on the lower face of one plate in mating engagement with the central rib on the upper face of an underlying plate. Preferably, each rib and indent has opposite sides which taper inwardly from the front edge to the rear edge of the plate.

The nesting ridge and indent has many advantages over a conventional button and hole nesting arrangement. The nesting rib or ridge and indent arrangement has greater plate-to-plate contact and occurs over a longer area, which provides much more resistance against side to side shifting of the plates. The tapered side edges of the ridge and indent also prevent the plates from shifting forwards relative to one another. Preferably, the entire center section of the plate is raised to form the opposing rib and indent, so that the overall thickness of the plate remains uniform. This will produce fewer imperfections during casting, where the plate is made from cast iron, and also improves nesting ability. The plate may be of cast iron, steel, or other materials.

Preferably, the rib and indent each have a linear keyway running away from the front edge and bisecting the selector stem aperture. When two plates are nested together, the keyway in the indent of one plate will be aligned with the keyway on the ridge or rib of the underlying plate, allowing a selector pin to be inserted between the two plates along the keyways and through a hole in the selector stem, in order to chose the number of weight plates to be lifted in an exercise.

According to another aspect of the present invention, a weight stack system for an exercise machine is provided, which comprises a plurality of identical weight plates stacked vertically, each plate having an upper face, a lower face, a front edge, and a rear edge, and a central selector stem aperture extending between the upper and lower faces and aligned with the other selector stem apertures in the stacked plates, and a raised central ridge section extending from the front edge to the rear edge to define a raised ridge on one face and a matching indent on the other face, whereby the raised ridge on one plate nests into the indent on an adjacent plate in the stack for nesting and alignment.

Preferably, each ridge and indent have opposite side edges which taper inwardly from the front edge to the rear edge of each plate. The mating ridges and indents thus resist relative side to side movement of the plates, as well as forward shifting of one plate relative to another in the stack.

In a preferred embodiment of the invention, a top plate is provided for placing on top of the stack and securing to the selector stem. The top plate is of similar shape and design to the plates in the remainder of the stack, but is preferably of smaller cross-sectional dimensions and greater thickness than the other weight plates. The top plate has the same raised central ridge as the other plates.

Preferably, a plurality of add-on weights are provided for selective placement on the top weight plate of the stack. Each add-on weight weighs less than the other plates in the stack. Each add-on weight comprises a plate having a front edge, a rear edge, opposite sides, and opposing upper and lower faces. The lower face has an indent for mating engagement with the raised ridge on the upper face of the top plate of the stack. The add-on weight has a through bore extending from the upper face to the lower face for alignment with the selector stem apertures, and a slot extending from one of the front or rear edges to the through bore for allowing the add-on weight plate to be fitted over the weight stack cable when being placed on top of the stack. Preferably, the indent terminates short of the rear edge, preventing the add-on weight from sliding forward and falling off the stack. The indent which fits over the raised ridge on the top plate prevents lateral sliding of the add-on weight. Add-on weights can be stacked on top of one another and locked in place. This allows ready and secure adjustment to provide intermediate weights between the weight stack plate weights.

The weight plate and weight stack system of this invention provide improved and more secure nesting ability, as well as a more aesthetic appearance to the weight stack, and more space conservation where multiple weight stacks must be arranged together.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which:

FIG. 4 is a top perspective view of the top weight of the weight plate system;

FIG. 5 is a bottom perspective view of the top weight;

FIG. 6 is a top perspective view of an add-on weight;

FIG. 7 is a bottom perspective view of the add-on weight;

FIG. 8 is a top view of the add-on weight;

FIG. 9 is a sectional view taken on line 9—9 of FIG. 8;

DESCRIPTION OF THE PREFERRED EMBODIMENT

Figure 1:
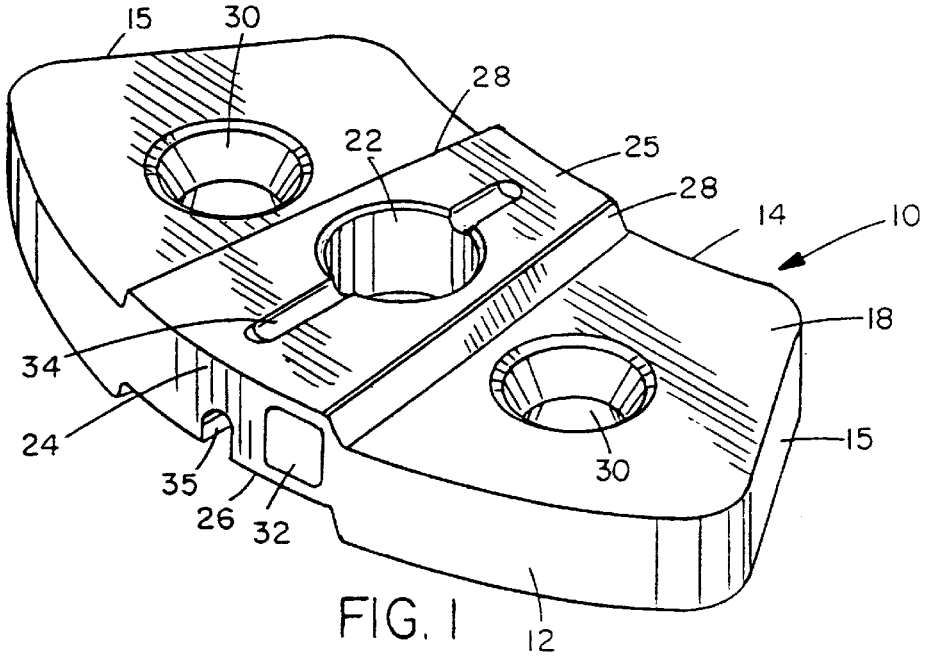
FIG. 1 is a top perspective view of the basic weight of a weight plate system according to a preferred embodiment of the present invention.
Figure 2:
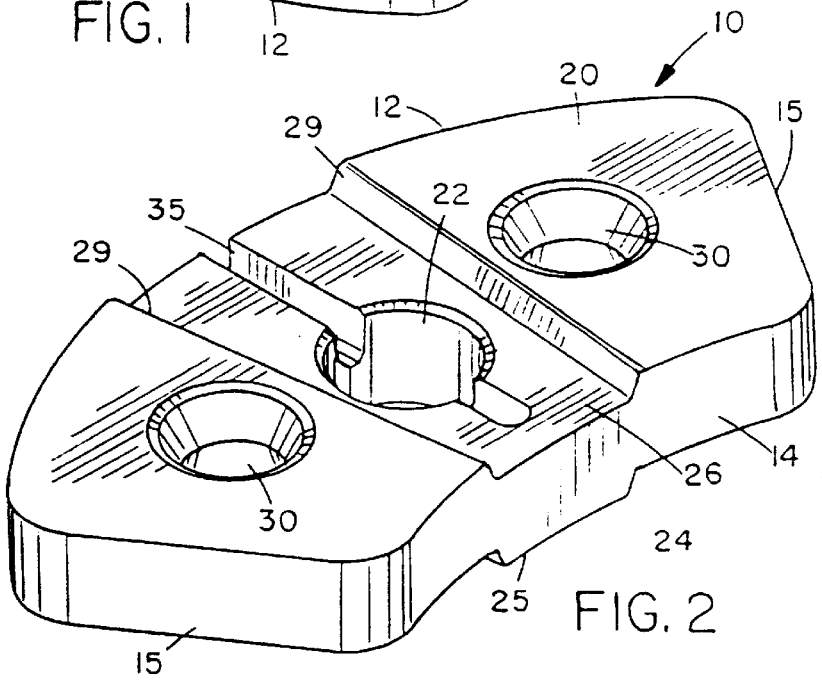
FIG. 2 is a bottom perspective view of the basic weight.
Figure 3:
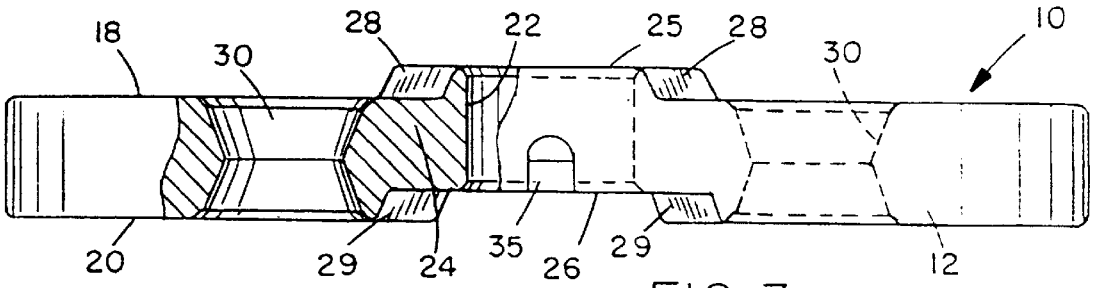
FIG. 3 is an enlarged front view of the weight, partially cut away.

FIGS. 1 to 3 of the drawings illustrate a weight plate 10 according to a preferred embodiment of the present invention. The plate 10 is designed to be stacked with a plurality of identical weight plates in a weight stack of an exercise machine, as described in more detail below in connection with FIGS. 10 to 13. The plate may be made of any suitable material, such as cast iron or steel.

Plate 10 has matching, parallel curved front and rear edges 12,14 and angled sides 15 extending from the front to the rear edge. Each side 15 is angled inwardly from the front to the rear edge of the plate. This is completely different from the conventional rectangular design of such weight plates in the past. The weight plate 10 also has an upper face 18 and a lower face 20, and a central, selector stem opening 22 extending from the upper face to the lower face. A central ridge or raised portion 24 extends from the front edge to the rear face, to form a raised rib 25 on the upper face and a matching indent 26 on the lower face, with opening 22 located in the raised ridge portion 24. The opposite sides 28 of the ridge or rib 25 and the corresponding opposite sides 29 of the indent 26 are tapered inwardly from the front edge to the rear edge of the plate. The opposite sides 28 preferably also have a slight outward taper from the upper face of the rib down to the remainder of the upper face of the plate, as best illustrated in FIG. 3, while the opposite sides 29 of the indent have a matching outward taper from the inner face of the indent down to the lower face of the plate.

The plate 10 also has two outer through holes 30, one on each side of the raised central portion 24. The outer holes are for guide rods on the exercise machine which guide the weight stack plates as they are moved up and down during exercises. The front edge or face 12 has a square indented region 32 for the placement of a number that may correspond to the sequential position of the plate or the accumulated weight of the plate in the stack.

The upper face of rib 25 and inner face of indent 26 each have a straight keyway or groove 34,35, respectively which runs in a straight line in a front to rear direction and which intersects the selector stem opening 22. The keyway 34 in the upper face of rib 25 terminates short of both the front and rear edge of the plate, while keyway 35 in the lower face intersects the front edge of the plate, and is deeper than keyway 34. The keyways 34,35 allow a selector pin to be inserted between two stacked plates and through a hole in a selector stem, as will be described in more detail below in connection with FIGS. 10 to 13.

The plate may be of any desired dimensions, depending on space availability and the desired incremental weight. In a preferred embodiment, each plate 10 had a thickness of around 1.125" ($2.85\times10^{-2}$ m), and the height of the rib and indent was 0.3" ($0.762\times10^{-2}$ m). The sides of the plate were angled outwardly from the rear to the front edge at an angle of around 68°, while the side walls of the rib end indent extended at an angle of around 14° to each other. The width from the front edge to the rear edge was around 4" ($10.16\times10^{-2}$ m). The radius of the front and rear edges was in the range from 7.5" to 8.0" ($19.05\times10^{-2}$ m to $20.32\times10^{-2}$ m). The length of the plate measured across the front edge was around 10" to 10.5" ($25.4\times10^{-2}$ m to $26.67\times10^{-2}$ m).

Figure 11:
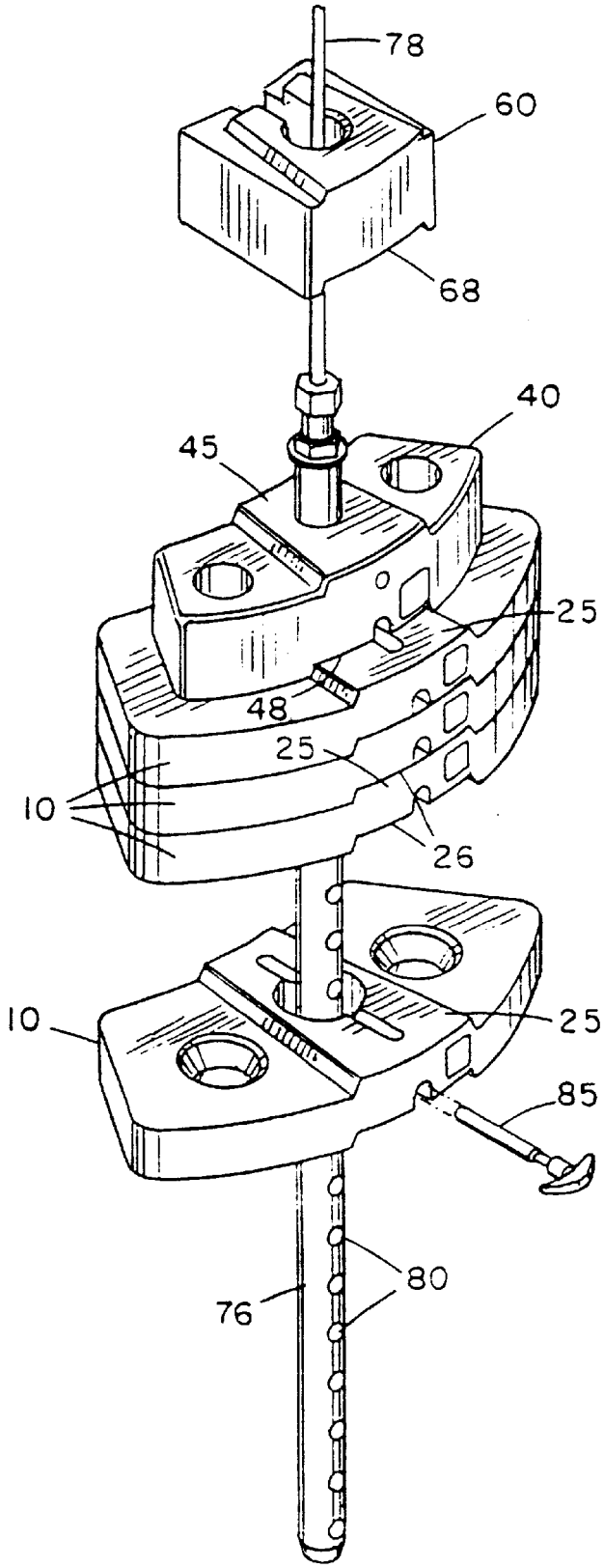
FIG. 11 is similar to FIG. 10 and shows the addition of weights and an add-on weight.
Figure 12:
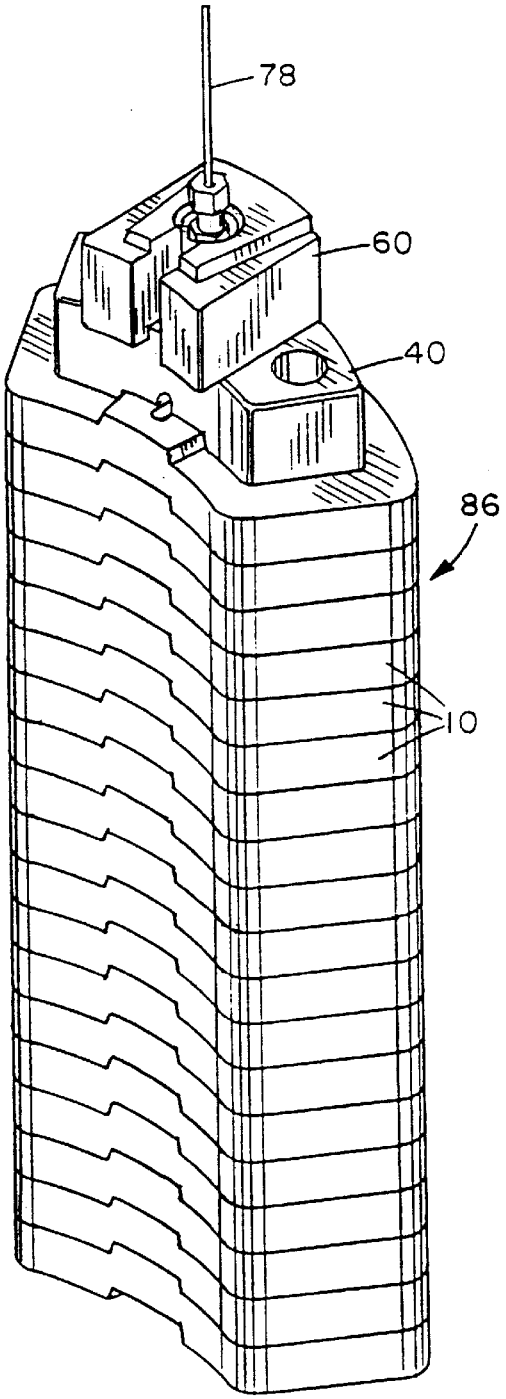
FIG. 12 is a rear perspective view of a complete weight stack.
Figure 13:
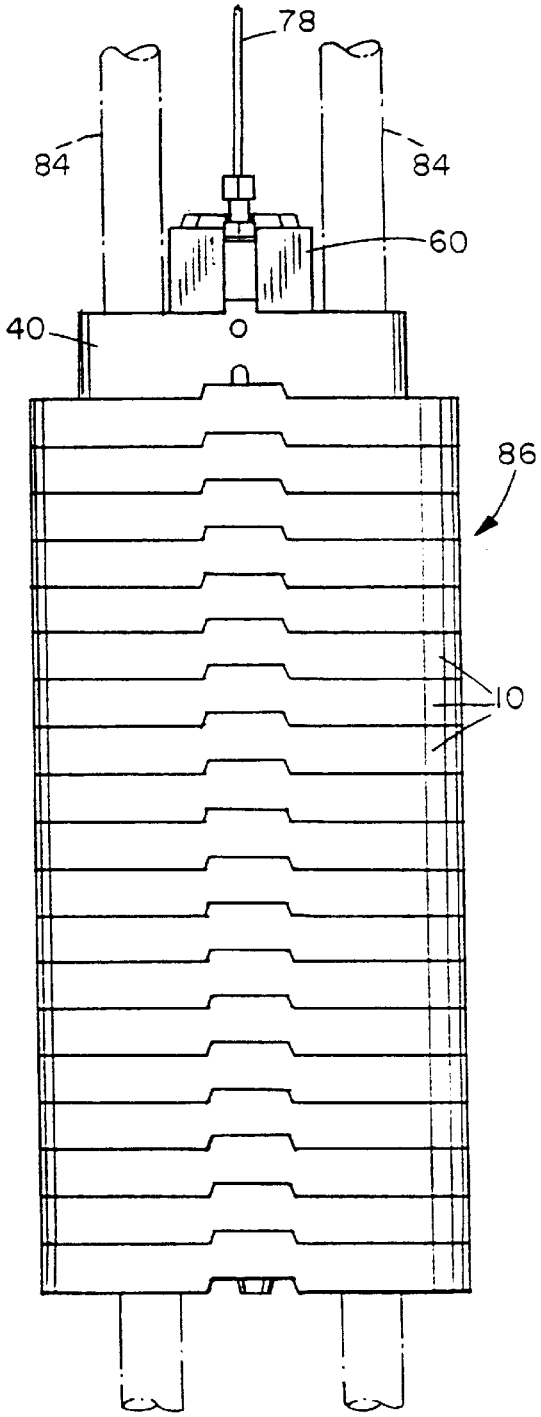
FIG. 13 is a rear view of the weight stack showing the guide rods.
Figure 15:
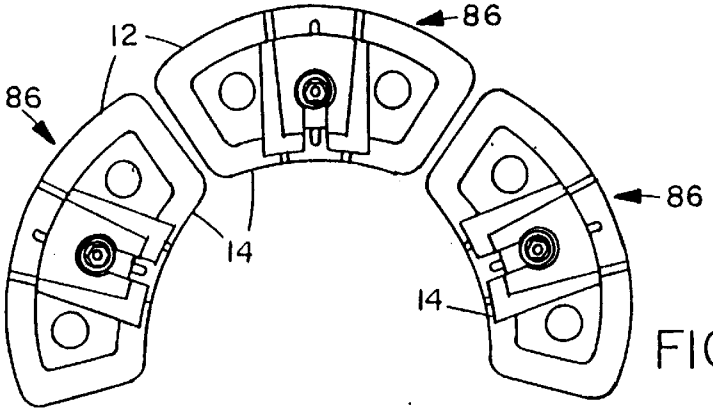
FIGS. 14–17 are top views illustrating various configurations of the weights on multiple position machines.
Figure 17:
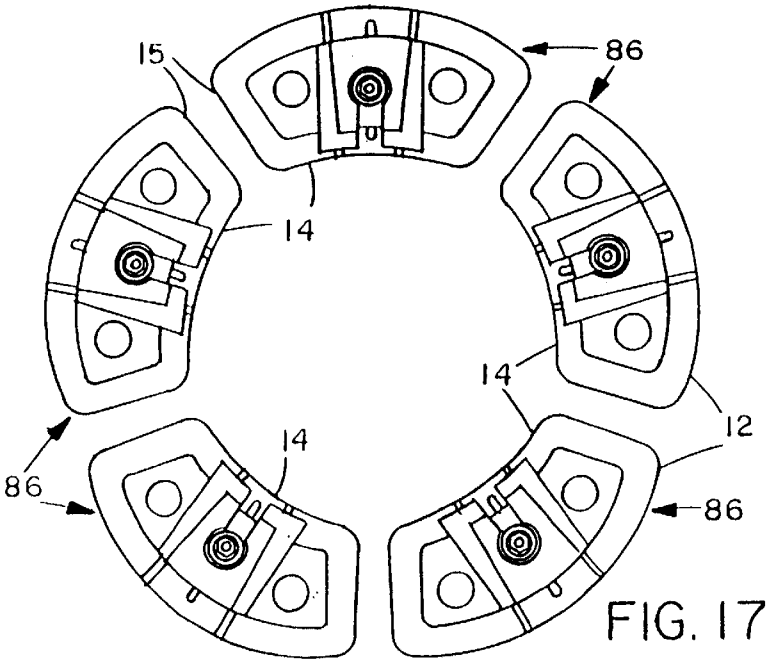
Figure 14:
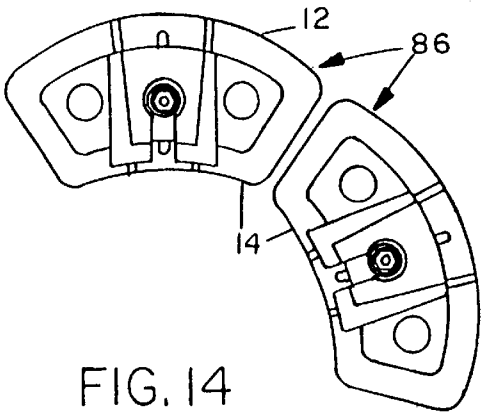
Figure 16:
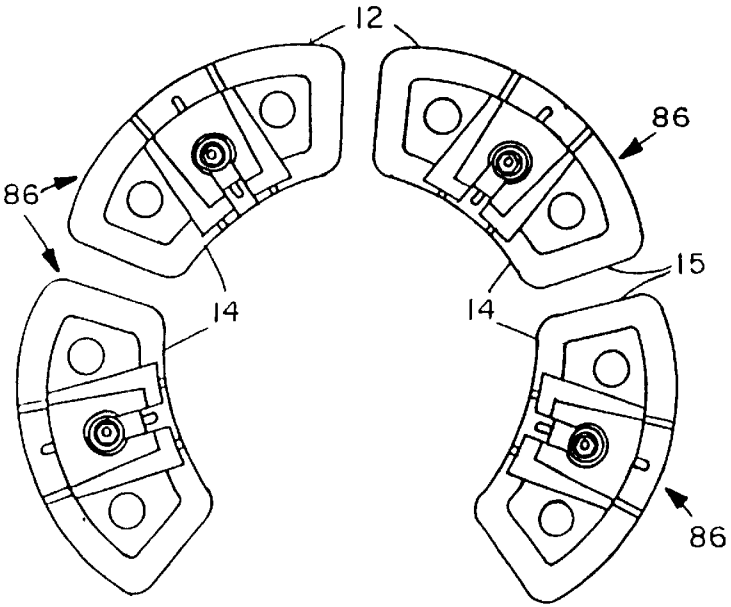

FIGS. 4 and 5 illustrate a top plate 40 for a weight stack according to the preferred embodiment of the invention. This plate has front and rear edges 41,42 and sides 43 of shape substantially matching that of plates 10, but is of smaller overall dimensions (length and width) than the other plates in the stack. The thickness of the plate 40 is greater than that of the other plates 10. Plate 40 has a raised ridge portion 44 of the same dimensions as ridge portion 24 of plates 10, forming a raised rib 45 on the upper face 46 of plate 40 and an indent 48 on the lower face 49. Indent 48 is shaped and dimensioned for mating engagement over the raised rib 25 of the uppermost plate 10 of a stack of plates, as illustrated in FIGS. 11 to 13.

A central opening 50 is provided in plate 40 for alignment with the selector stem openings 22 of stacked plates 10, and side openings 52 align with the side openings 30 of plates 10 when the plates are stacked together. The indent 48 has a central keyway 54 extending from the front edge across opening 50 and up to the rear edge of the plate 40. The keyway 54 is of shape and dimensions substantially matching lower keyways 35 in the plates 10, but does not terminate short of the rear edge, unlike keyways 35. No keyway is provided on the upper face of rib 45. A square indented region 55 identical to indented regions 32 on plates 10 is provided on the front edge or face 41 of the plate 40. An additional hole 56 runs from the front edge to the rear edge of plate 40, in order to attach the plate 40 to a selector stem, as described in more detail below. In a preferred embodiment, plate 40 had a thickness of 2" (i.e. nearly twice that of plate 10), a width of around 3.4" ($8.6\times10^{-2}$ m, and an overall length of about 7" ($17.8\times10^{-2}$ m).

FIGS. 6 to 9 illustrate an add-on weight plate 60 for selective addition to a weight stack of plates 10 and top plate 40, as described in more detail below in connection with FIGS. 11 to 13. The weights 10 will each be of a standard incremental weight such as 5 lbs, so that these can be used to increment the amount of weight lifted in weight steps of 5 lbs., i.e. 5 lbs, 10 lbs, 15 lbs, and so on. Add-on weight plate 60 is of a weight less than that of a single plate 10, and can be used as desired to increase the overall weight lifted by smaller increments than provided by adding another of the main stack weights 10.

Plate 60 is of smaller cross-sectional dimensions than the plates 10 or 40, and is thicker than the other plates. It has an arcuate front and rear face 61,62, and generally straight sides 64. The upper face 65 has a raised rib portion 66 which terminates short of rear face 62, while the lower face 67 has a corresponding indented portion 68 which also terminates short of the rear face or edge 62. The shape and dimensions of the rib and indented portions 66,68 substantially match those of the ribs and indents on the plates 10 and 40, and indented portion 68 is designed for mating engagement over the raised rib 45 on the upper face of the top plate 40 of the stack.

Plate 60 has a central opening or through bore 70 for alignment with the selector stem openings 22 and 50 of the plates 10 and 40, respectively. A slot 72 extends from the rear edge 62 into opening 70, to permit the plate 60 to be engaged over the weight stack cables and fitted over the top plate rib, as described in more detail below.

Add-on plates 60 are preferably formed with a rubber molded exterior 74 and a cast iron core 75, as illustrated in FIG. 9. They may be provided in various incremental weights of 5 lbs. or less. In a preferred embodiment, each plate 60 had a thickness of 2" to 2.5" ($5.08\times10^{-2}$ m to $6.35\times10^{-2}$ m), a width of 3.7" ($9.4\times10^{-2}$ m), and a length of about 3.375" ($8.57\times10^{-2}$ m) between the opposite side faces.

FIGS. 10 to 13 illustrate how weight plates 10,40 and 60 may be installed on a conventional weight stack selector stem 76 of a weight lifting exercise machine. The weight stack stem 76 is attached to a cable 78 linked to one or more exercise stations in a conventional manner. Stem 76 has a series of openings 80 for receiving a selector pin 85 in order to adjust the amount of weight to be lifted, as discussed below.

Figure 10:
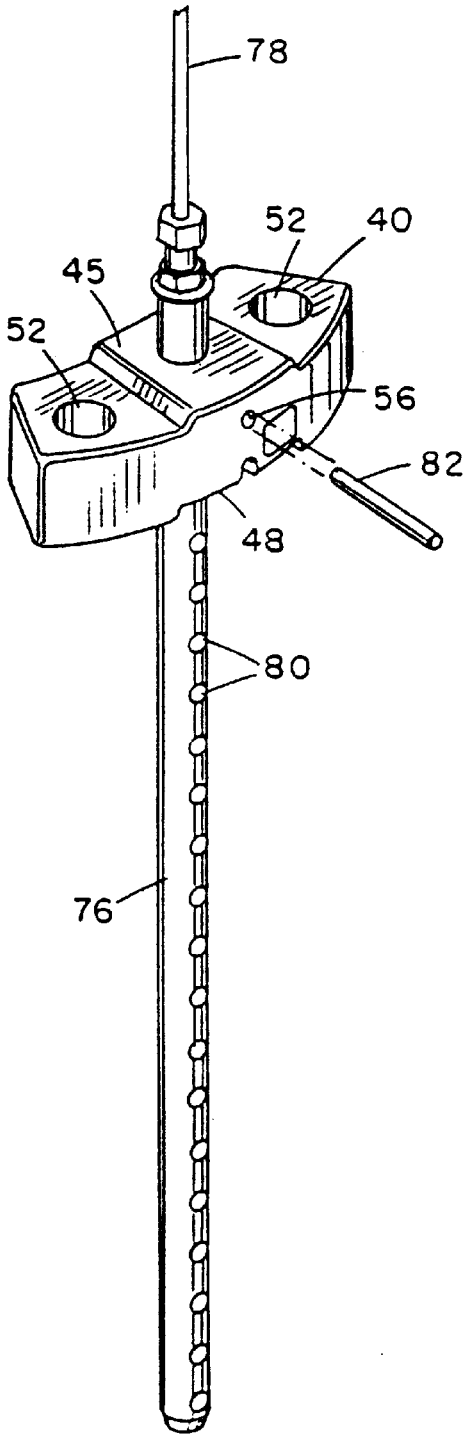
FIG. 10 is a perspective view showing the attachment of the top weight to a weight stem.

The top plate 40 of the stack is secured to the upper end of the selector stem 76 by a pin 82 extending through bore or hole 56 into an aligned opening 80 in stem 76, as best illustrated in FIG. 10. A plurality of plates 10 will first be engaged in a stack by sliding each plate over the stem 76 and guide rods 84, and engaging the indent on the lower face of each plate 10 over the rib 25 on the upper face of the underlying plate, as illustrated in FIGS. 11 to 13. Selector pin 85 may be inserted between any selected pair of plates 10 in order to determine the number of plates 10 which will be lifted along with top plate 40 by an exerciser. The pin 85 will be inserted through the selected keyway 35 and, once fully inserted, the enlarged portion of the pin 85 will engage in underlying keyway 34 of the plate below, so that the pin is secured in position and cannot be accidentally displaced. Keyway 34 will also serve to re-locate the pin as the weight stack above the pin is lowered back down onto the remainder of the stack on completion of an exercise.

FIGS. 11 to 13 also illustrate selective engagement of an add-on weight 60 on top of a stack 86. As illustrated in FIG. 11, the weight 60 is first engaged over cable 78 via slot 72, until opening 70 is aligned with opening 50 in the top plate. Weight 60 then slides down until indent 68 engages over the raised rib 45 in the top plate 40, as illustrated in FIGS. 12 and 13. Side-to-side movement of the add-on plate 60 relative to the stack is resisted by the interlocking engagement between indent 68 and rib 45, so that the plate 60 cannot engage and rub against the guide rods. Forward movement of plate 60 relative to plate 40 is prevented by the outwardly tapering sides of the interengaging indent 68 and rib 45, and also by the engagement of the inner end of indent 68 over the rear end of rib 45. Rearward movement of plate 60 is prevented by the engagement of opening 70 over stem 76. Thus, the plate 60 can be readily removed from the stack and replaced as needed, yet is securely positioned on top of the stack and cannot move accidentally or fall off the stack. Any number of add-one weights 60 may be stacked vertically on top of one another over top plate 40, according to the desired incremental weight adjustment.

FIGS. 14 to 17 illustrate several possible space conserving arrangements of a plurality of weight stacks 86. This illustrates one of the major advantages of the arcuate front and rear edge and tapering or radial sides of the plates and overall stack where two or more weight stacks are required in a multi-station exercise machine. FIGS. 14 to 17 illustrate a part-circular or circular arrangement of two, three, four, or five weight stacks 86 for a multi-station machine. This arrangement takes up much less space than a corresponding arrangement of rectangular weight stacks, and provides a center opening for running cables. The angle of the sides 15 of the plate may be selected based on how many weight stacks are desired to form a complete circular array as in FIG. 16. It will be understood that the sides 15 of the plates for a five stack array forming a circle as in FIG. 17 will be at an angle of around 72° to each other, or at an angle of around 34° to 36° to the central axis of the respective plate. However, other angles may be selected for the sides, depending on how the weight stack is to be used.

An individual weight stack 86 of the illustrated shape also has advantages over a single weight stack of rectangular shape. The concave shape of the rear face of the stack provides a space between the center of the rear face and the two outer ends, which allows for routing a cable without taking up any extra space behind the machine. Thus, the arcuate front and rear edges and radial side edges have many advantages over traditional rectangular weight stack plates, and also have a more attractive appearance. Although the plates preferably have the raised rib and indent interlocking arrangement as illustrated in the drawings, other types of interlock mechanism may alternatively be used.

The drawings illustrate a preferred taper angle for the side edges of the plates and the interlocking rib and indent. However, it will be understood that different side edge angles may be provided for either the plate side edges, the rib and indent side edges, or both. Additionally, rather than angling inwardly and rearwardly as illustrated, the plate side edges may alternatively angle outwardly towards the rear edge of the plate.

Instead of having aligned keyways in the lower face of the indent and the upper face of the mating rib for receiving the selector pin, a single opening may be drilled through the center of the raised portion 24 forming the rib and indent. Although all of the weight plates are preferably made of cast iron, they may alternatively be formed from other materials such as steel plate.

The preferred interlocking mechanism between adjacent plates in the stack also has many advantages over a conventional button and hole interlock arrangement. The raised rib and indent arrangement provides a much greater plate to plate contact surface area than a button and hole, and extends over a longer distance, to provide more resistance to side-to-side shifting of plates in the stack. At the same time, the overall plate thickness is kept constant since the entire central section of the plate is offset upwardly, rather than providing a thickened rib portion. This provides more uniformity if the plate is formed by casting.

The inward taper of the sides of the rib and indent from the front to the rear helps to prevent forward shifting of any plate in the stack. The plates are also easier to nest and align together than in previous designs. Although this nesting arrangement is preferably used on plates with arcuate front and rear edges and tapering sides as illustrated in the drawings, it may also be used advantageously on a rectangular shaped plate for a weight stack.

In the weight stack system of this invention, the basic weight plates interlock securely with each other, the top weight plate interlocks with the basic weights, and add-on weights interlock on top of the top plate. The completed weight stacks can be arranged in a circular array to form a tight cluster of two, three, four or five stacks, conserving floor space. Shifting of one plate relative to others in the stacks is prevented by the unique interlocking rib and indent arrangement.

Although a preferred embodiment of the invention has been described above by way of example only, it will be understood by those skilled in the field that modifications may be made to the disclosed embodiment without departing from the scope of the invention, which is defined by the appended claims.

We claim:

1. A stackable weight for an exercise machine weight stack, comprising:

a plate of predetermined weight having front and rear edges, opposite side edges, upper and lower faces, and a selector stem aperture extending between the upper and lower faces;

the upper face having a raised central rib extending from the front edge to the rear edge and the lower face having a central indent extending from the front edge to the rear edge and of shape and dimensions matching that of the central rib on the upper face, whereby plates can be stacked together with the central indent on the lower face of one plate in mating engagement with the central rib on the upper face of an underlying plate;

the rib and indent each having a linear keyway of width less then the width of the rib and indent, each keyway bisecting the selector stem aperture whereby, when two plates are nested together, the keyway in the indent of one plate will be aligned with the keyway on the rib of the underlying plate; and the keyway in the indent extending from the front edge of the plate for allowing a selector pin to be inserted between the two plates along the keyways and through a hole in a selector stem, in order to chose the number of weight plates to be lifted in an exercise.

2. The weight as claimed in claim 1, wherein the rib has an upper flat face, and each side of the rib tapers outwardly from the upper face of the rib to the upper face of the remainder of the plate.

3. The weight as claimed in claim 2, wherein the indent has a flat inner face, and each side of the indent tapers outwardly from the inner face of the rib to the lower face of the plate.

4. The weight as claimed in claim 1, wherein the plate has a central raised section forming said rib and indent, and opposite side portions on opposite sides of said central raised section, the plate thickness at said central section being the same as the plate thickness in said side portions.

5. A weight stack system for an exercise machine, comprising:

a plurality of identical weight plates stacked vertically, each plate having an upper face, a lower face, a front edge, and a rear edge, and a central selector stem aperture extending between the upper and lower faces and aligned with the other selector stem apertures in the stacked plates, the aperture having a predetermined cross-sectional dimension;

each plate having a raised central ridge section extending from the front edge to the rear edge to define a raised ridge on one face and a matching indent on the other face, whereby the raised ridge on one plate nests into the indent on an adjacent plate in the stack for nesting and alignment;

the ridge and indent each being of width greater than the cross-sectional dimension of the aperture and having a opposite side edges which are spaced outwardly from said aperture;

a top plate for placing on top of the stack and securing to a weight stack stem, the top plate having opposite upper and lower faces and a raised central ridge section matching that of the other plates for mating engagement over the raised ridge of the uppermost plate in the stack; and a plurality of add-on weights for selective placement on the top weight plate of the stack, each add-on weight comprising a plate of smaller cross-sectional dimensions than the weight plates and top plate, the add-on weight plate having a front edge, a rear edge, opposite side edges, and opposing upper and lower faces, the lower face having an indent for mating engagement with the raised ridge on the upper face of the top plate of the stack, and the add-on weight having a through bore extending from the upper face to the lower face for alignment with the selector stem apertures of the other plates in the stack.

6. The system as claimed in claim 5, wherein each add-on weight has a slot extending from one of the edges to the through bore for allowing the add-on weight plate to be fitted over the weight stack cable when being placed on top of the stack.

7. The system as claimed in claim 5, wherein the indent in the add-on weight terminates short of the rear edge of the add-on weight plate.

8. The system as claimed in claim 5, wherein each add-on weight plate has a raised ridge on its upper face for selective mating with an additional add-on weight plate stacked on top of it.

9. A weight stack system for an exercise machine, comprising:

a plurality of identical weight plates stacked vertically, each plate having an upper face, a lower face, a front edge, and a rear edge, and a central selector stem aperture extending between the upper and lower faces and aligned with the other selector stem apertures in the stacked plates, the aperture having a predetermined cross-sectional dimension;

each plate having a raised central ridge section extending from the front edge to the rear edge to define a raised ridge on one face and a matching indent on the other face, whereby the raised ridge on one plate nests into the indent on an adjacent plate in the stack for nesting and alignment;

the ridge and indent each being of width greater than the cross-sectional dimension of the aperture and having a opposite side edges which are spaced outwardly from said aperture; and each plate having parallel, arcuate front and rear edges.

10. The system as claimed in claim 9, wherein the front edge is convex and the rear edge is concave, and the sides taper inwardly at a predetermined angle from the front edge to the rear edge.

11. A weight stack system for an exercise machine, comprising:

a plurality of identical weight plates stacked vertically to form a first stack, each plate having an upper face, a lower face, a front edge, a rear edge, opposite sides, and a central selector stem aperture extending between the upper and lower faces and aligned with the other selector stem apertures in the stacked plates;

the front and rear edges comprising parallel, arcuate edges extending between the opposite sides of each weight plate; and at least one additional stack of weight plates identical to the first stack, the two stacks being placed side-by-side with one side of one stack being positioned adjacent a side of the other stack and the two stacks extending on an arc of a circle.

12. The system as claimed in claim 11, wherein a plurality of stacks of the weight plates are arranged in a circular array with a central opening.

13. The system as claimed in claim 12, wherein there are five stacks in the circular array.

14. The system as claimed in claim 13, wherein each plate has a central axis extending from said front edge to said rear edge, and each side extends at an angle of approximately 35° to said central axis.

* * * * *

UNITED STATES PATENT AND TRADEMARK OFFICE

CERTIFICATE OF CORRECTION

PATENT NO. : 6,497,639 B2
DATED : December 24, 2002
INVENTOR(S) : Randall T. Webber It is certified that error appears in the above-identified patent and that said Letters Patent is hereby corrected as shown below:

Column 9,
Line 33, delete “a”.

Column 10,
Line 34, delete “a”.

Signed and Sealed this

Twenty-second Day of April, 2003

JAMES E. ROGAN
*Director of the United States Patent and Trademark Office*